US006899000B1

(12) United States Patent
Hsien

(10) Patent No.: US 6,899,000 B1
(45) Date of Patent: May 31, 2005

(54) WRENCH OPEN END HAVING A PUSHING TONGUE

(76) Inventor: Chih-Ching Hsien, No. 367, Pei-Yang Rd., Feng Yuan, Taichung (TW)

( * ) Notice: Subject to any disclaimer, the term of this patent is extended or adjusted under 35 U.S.C. 154(b) by 0 days.

(21) Appl. No.: 10/718,633

(22) Filed: Nov. 24, 2003

(51) Int. Cl.[7] ..... B25B 13/02; B25B 13/46
(52) U.S. Cl. ..... 81/176.2; 81/119; 81/186
(58) Field of Search ..... 81/176.1, 176.2, 81/119, 125, 124.2, 124.3, 186, 180.1

(56) References Cited

U.S. PATENT DOCUMENTS 2,655,065 A * 10/1953 Murphy ..... 81/119
3,802,303 A * 4/1974 Evans et al. ..... 81/185
3,858,467 A * 1/1975 Evans ..... 81/179
5,307,713 A * 5/1994 White ..... 81/180.1
5,429,018 A * 7/1995 Miller ..... 81/186
6,186,032 B1 * 2/2001 Raines ..... 81/119

* cited by examiner

*Primary Examiner*—Jacob K. Ackun, Jr.

(57) ABSTRACT

A wrench includes an open end which includes two jaws and a connection portion connected between the two jaws. A clamping portion is defined in an inside of each jaw and located close to a first side of each jaw. A loose portion is defined in the inside of each jaw and located close to a second side of each jaw. A width between the two respective loose portions of the two jaws is wider than a width between the two respective clamping portions of the two jaws. A pushing tongue is located between the two jaws. A nut can be clamped by the clamping portions of the two jaws by compressing the pushing tongue, and is freely rotatable relative to the open end when located in a space enclosed by the loose portions.

8 Claims, 9 Drawing Sheets

WRENCH OPEN END HAVING A PUSHING TONGUE

FIELD OF THE INVENTION

The present invention relates to a wrench that includes an open end and a pushing tongue is located between jaws. Each jaw has a clamping portion and a loose portion which is recessed inward from the inside of each jaw.

BACKGROUND OF THE INVENTION

A conventional wrench includes a handle and an open end which has two jaws and a U-shaped clamping opening is defined between the two jaws. The width of the clamping opening is designed to accommodate a bolt head or a nut and the two jaws clamp two sides of the object by the clamping surfaces thereof. By rotation of the wrench, the nut clamped by the two jaws can be rotated. Nevertheless, after the handle is rotated an angle, the open end has to be removed from the nut and be mounted to the nut again. If there are objects located around the nut, the handle can only be rotated a limited angle. In this situation, the user has to repeatedly mount and remove the open end. This takes a lot of time and affects the efficiency of work.

The present invention intends to provide a wrench having an open end including two jaws. Each jaw includes a clamping portion and a loose portion which is recessed inward from an inside of each jaw. A pushing tongue is located between the two jaws so that the nut can be clamped by the clamping portions by compressing the pushing tongue, and freely rotated when being pushed to the space enclosed by the loose portions by the pushing tongue.

SUMMARY OF THE INVENTION

The present invention relates to a wrench which comprises a handle with an open end connected to an end thereof and the open end includes two jaws connected by a connection portion. A clamping portion is defined in an inside of each jaw and located close to a first side of each jaw. A loose portion is defined in the inside of each jaw and located close to a second side of each jaw. A width between the two respective loose portions of the two jaws is wider than a width between the two respective clamping portions of the two jaws. A pushing tongue is located between the two jaws.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
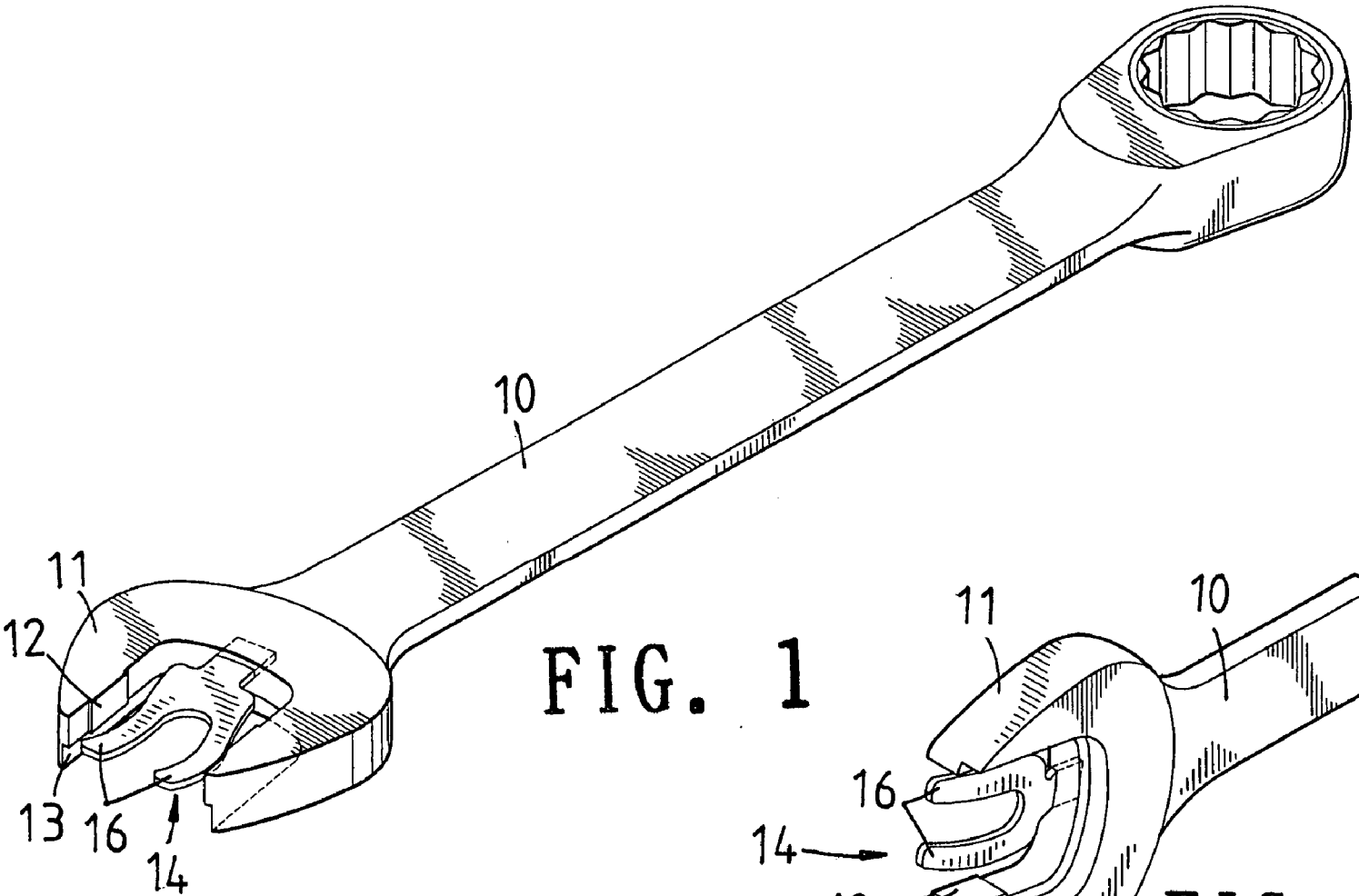
FIG. 1 is a perspective view to show the wrench of the present invention.
Figure 2:
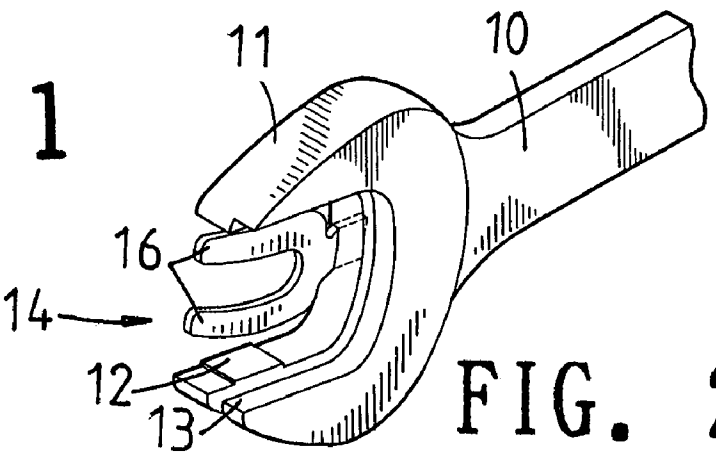
FIG. 2 shows the open end of the wrench of the present invention.
Figure 3:
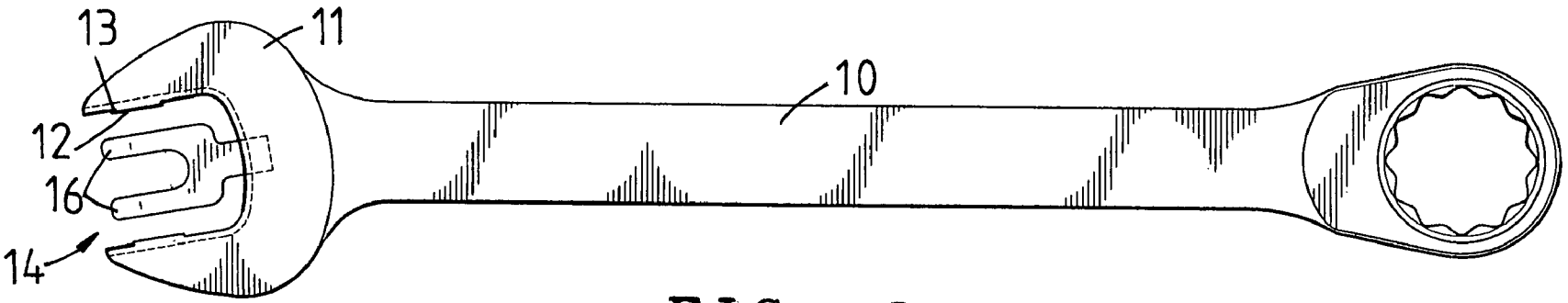
FIG. 3 is a top view of the wrench of the present invention.
Figure 4:
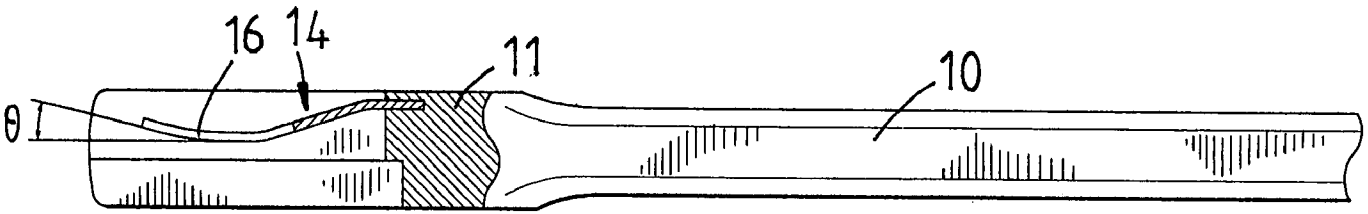
FIG. 4 is a cross sectional view of the open end of the present invention.
Figure 5:
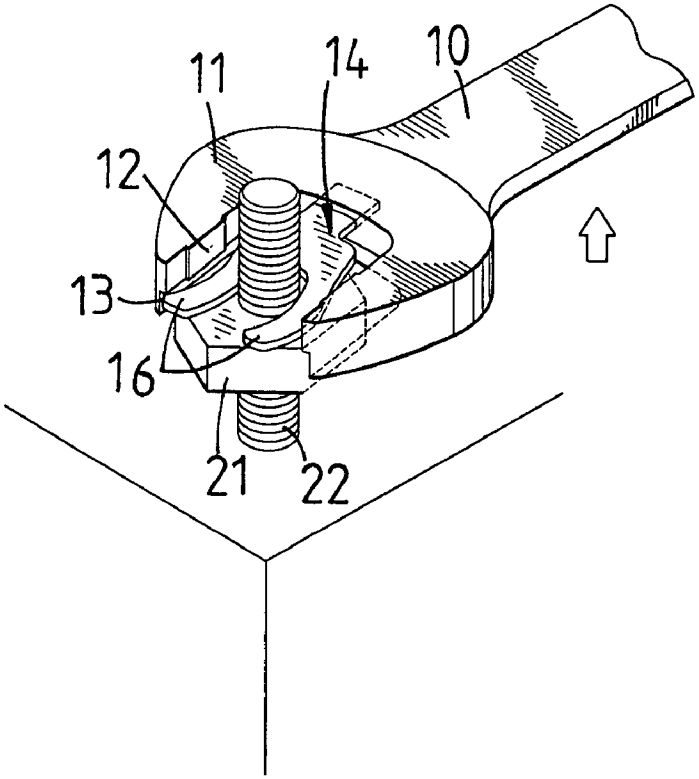
FIG. 5 shows the nut is located in a space enclosed by the loose portions.

Referring to FIGS. 1 to 4, the wrench of the present invention comprises a handle 10 having an open end and a box end connected to two opposite ends of the handle 10. The open end includes two jaws 11 and a U-shaped connection portion is connected between the two jaws 11. A clamping portion is defined in an inside of each jaw 11 and located close to a first side of each jaw 11, and a loose portion 13 is defined in the inside of each jaw 11 and located close to a second side of each jaw 11. The clamping portions 12 each have a protrusion extending therefrom in this embodiment. A width between the two respective loose portions of the two jaws is wider than a width between the two respective clamping portions of the two jaws. A pushing tongue 14 has one an end extending from the connection portion at a position close to the first side of the open end and is located between the two jaws 11. A distal end of the pushing tongue 14 extends upward an angle θ which is 20 to 30 degrees relative to a body of the pushing tongue 14 and is fork-shaped end 16.

Figure 6:
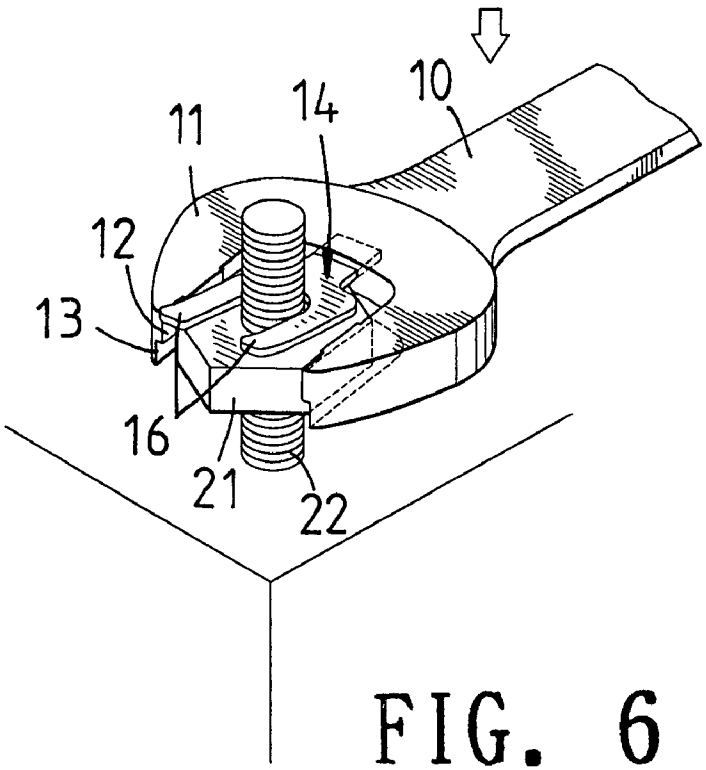
FIG. 6 shows the nut is clamped by the clamping portions by compressing the pushing tongue.
Figure 7:
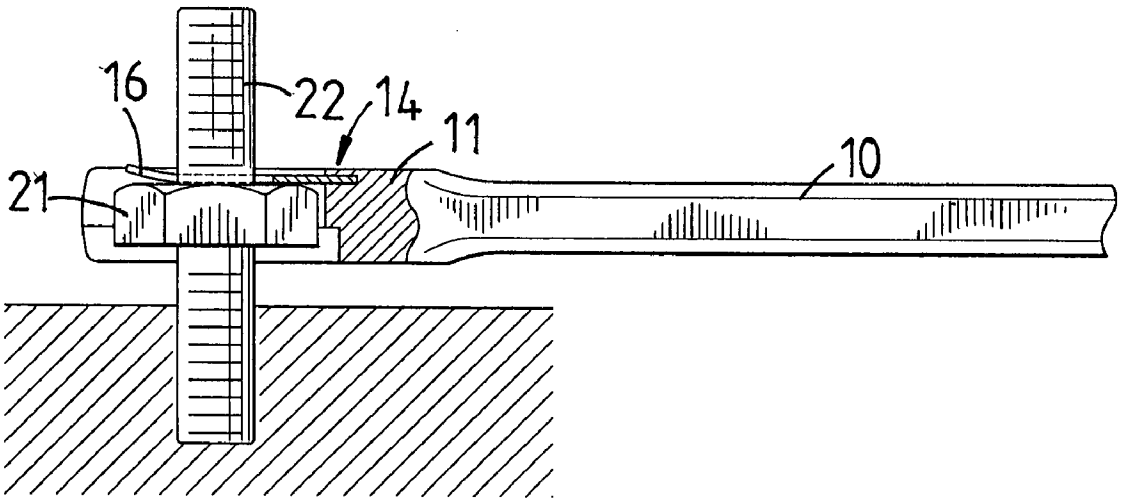
FIG. 7 is a cross sectional view to show the position of the nut in FIG. 5.
Figure 8:
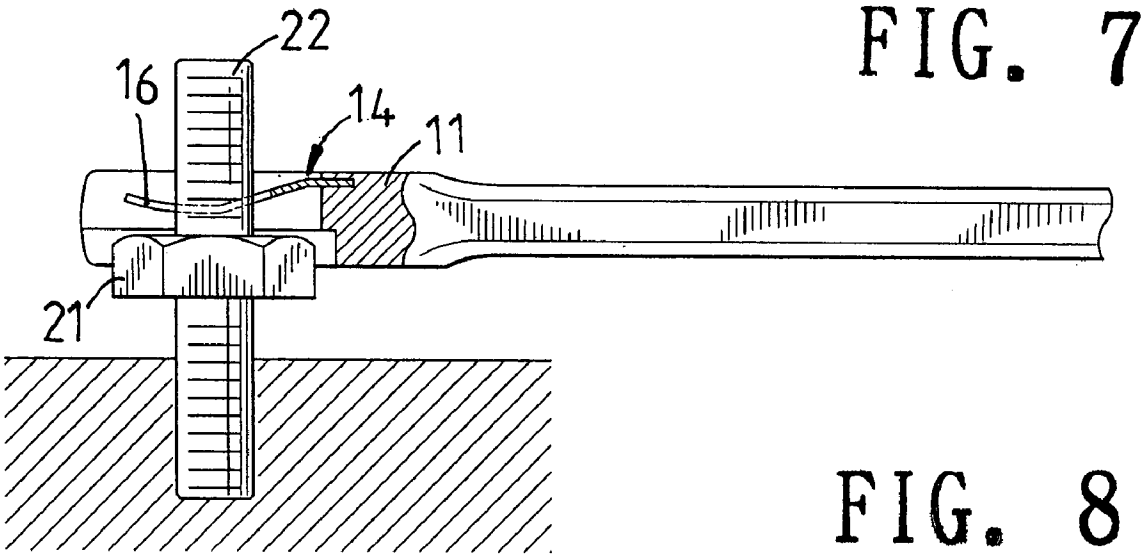
FIG. 8 is a cross sectional view to show the position of the nut in FIG. 6.

As shown in FIGS. 5 to 8, when driving a nut 21 on a threaded rod 22 by the open end 11 of the wrench, the threaded rod 22 is engaged with the fork-shaped end 16 of the pushing tongue 14 and the nut 21 is clamped by the clamping portions 12 by pushing the open end 11 downward to let the pushing tongue 14 be compressed as shown in FIG. 6. The nut 21 is then able to be rotated with the wrench. When releasing the wrench, the bias force of the pushing tongue 14 raises the open end 11 upward so that the nut 21 is located in a space enclosed by the loose portions 13. Therefore, the open end 11 can be rotated regardless of the nut 21.

Figure 9:
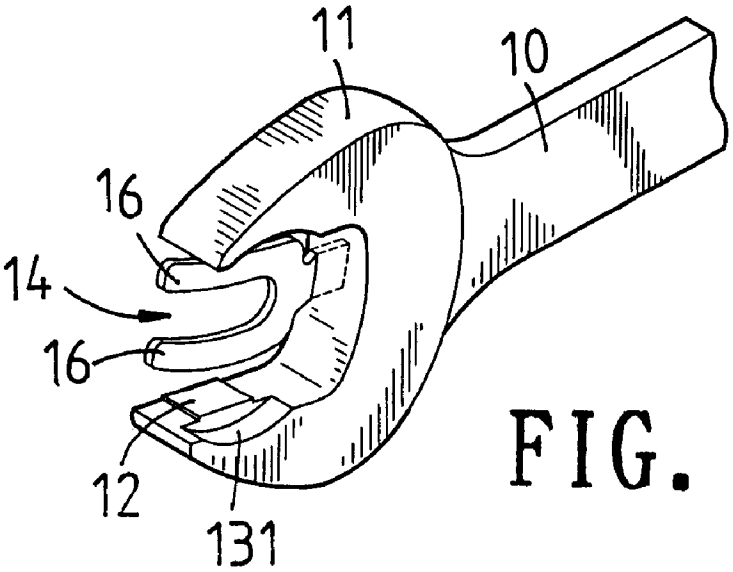
FIG. 9 is a perspective view to show another embodiment of the loose portions.
Figure 10:
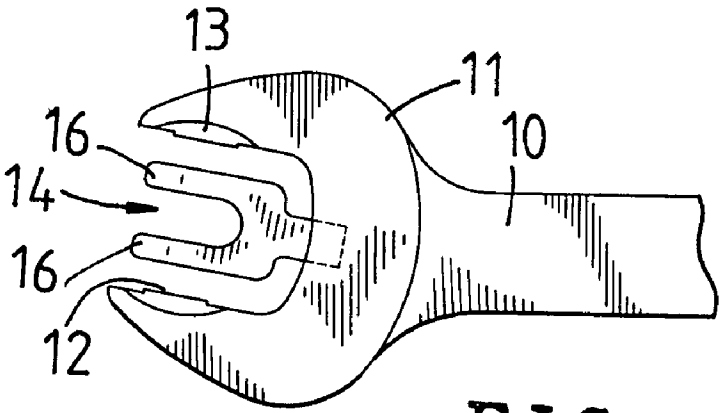
FIG. 10 is a bottom view to show the loose portions as disclosed in FIG. 9.
Figure 11:
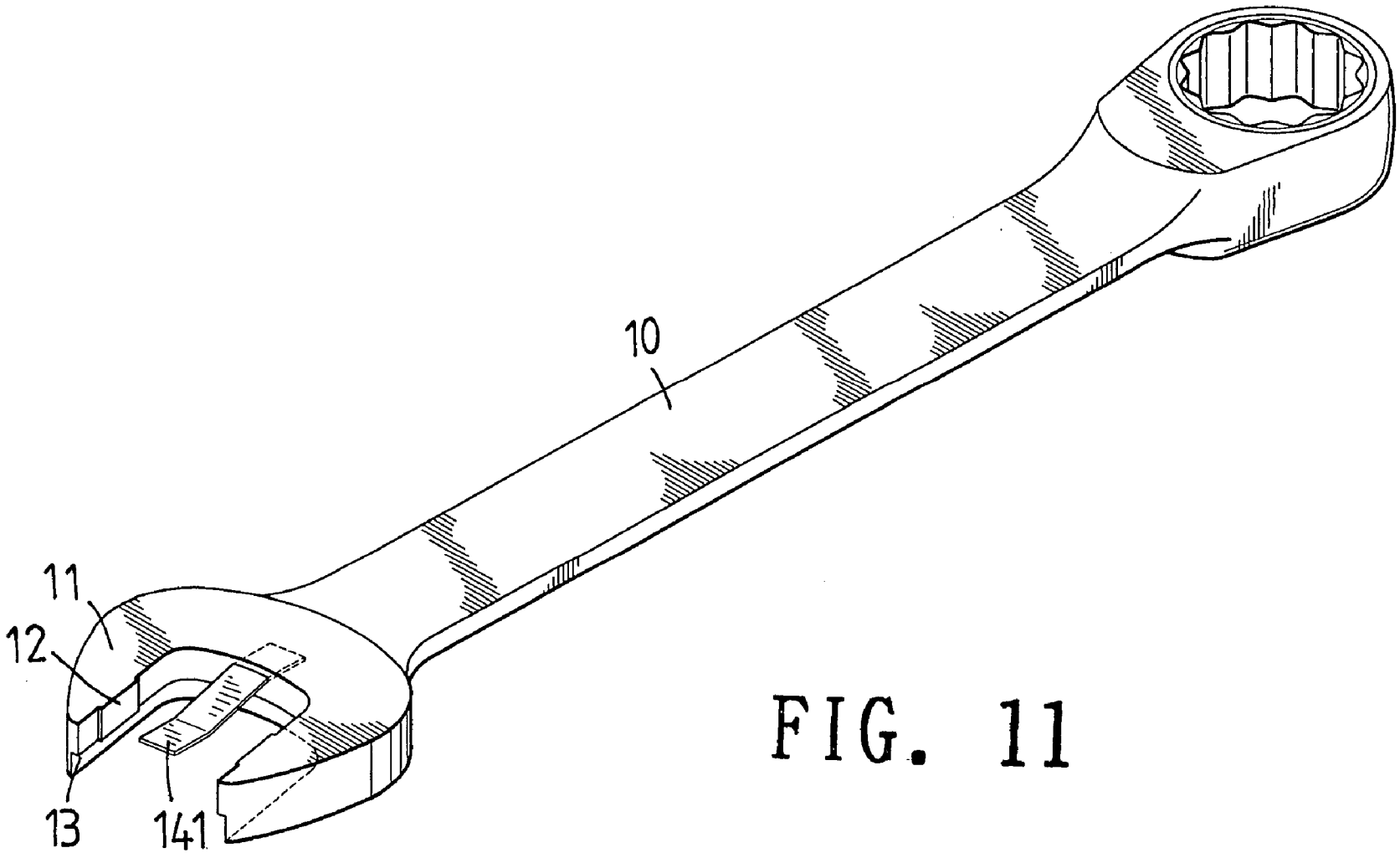
FIG. 11 shows another embodiment of the pushing tongue.
Figure 13:
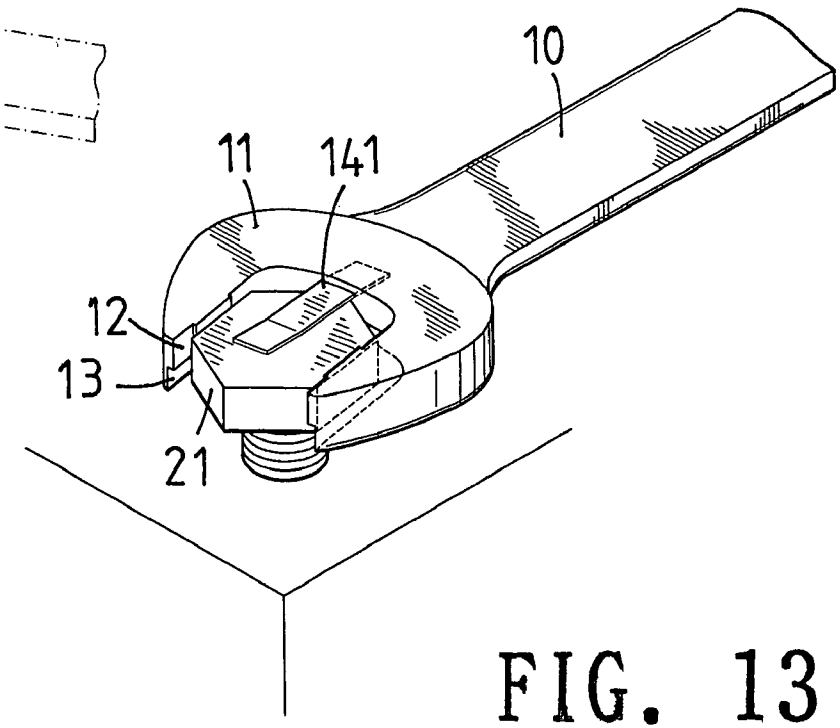
FIG. 13 shows the nut is clamped by the clamping portions by compressing the pushing tongue as shown in FIG. 11.
Figure 12:
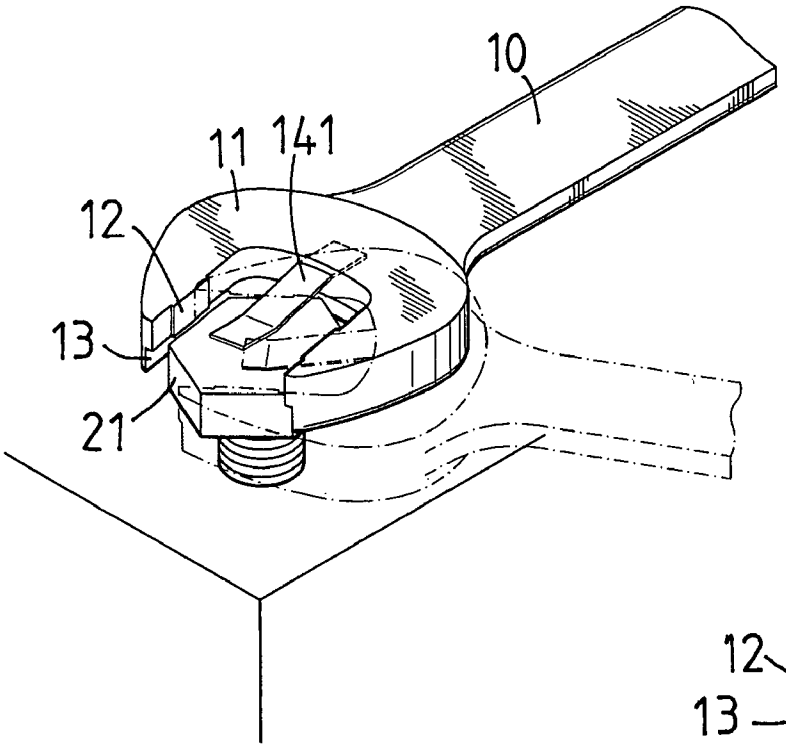
FIG. 12 shows the nut is located in a space enclosed by the loose portions with the pushing tongue in FIG. 11.
Figure 14:
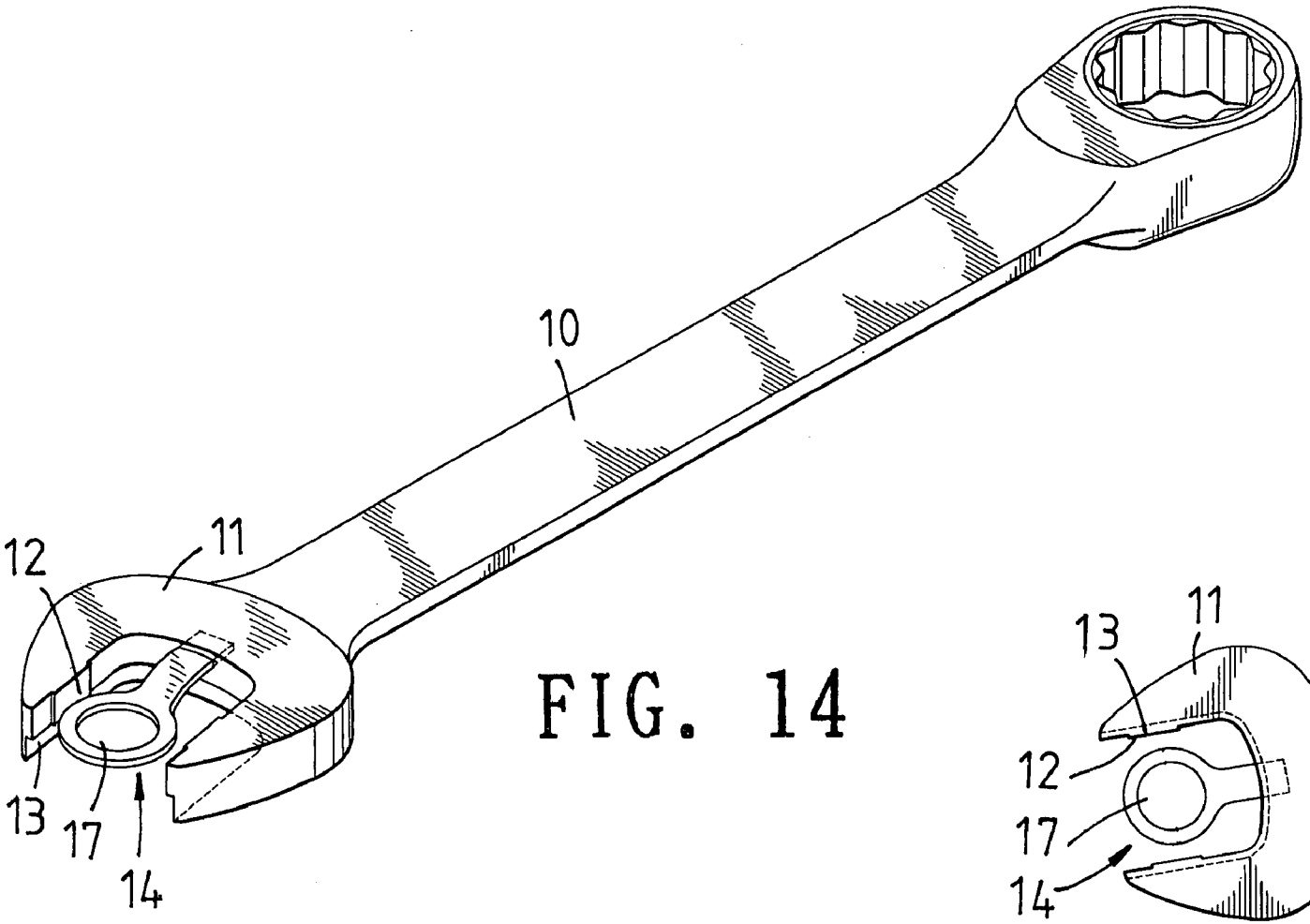
FIG. 14 shows yet another embodiment of the pushing tongue.
Figure 15:
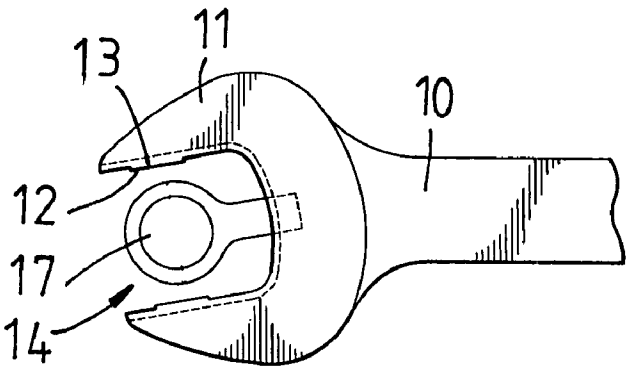
FIG. 15 is a plain view to show the open end with the pushing tongue as disclosed in FIG. 14.

FIGS. 9 and 10 show that each of the loose portions 13 can be made to be a curved recess 131. Referring to FIGS. 11 to 13, the pushing tongue 141 can be made as a strip with its distal end extending upward. FIGS. 14 and 15 show that the distal end of the pushing tongue 14 is a ring-shaped end 17.

Figure 16:
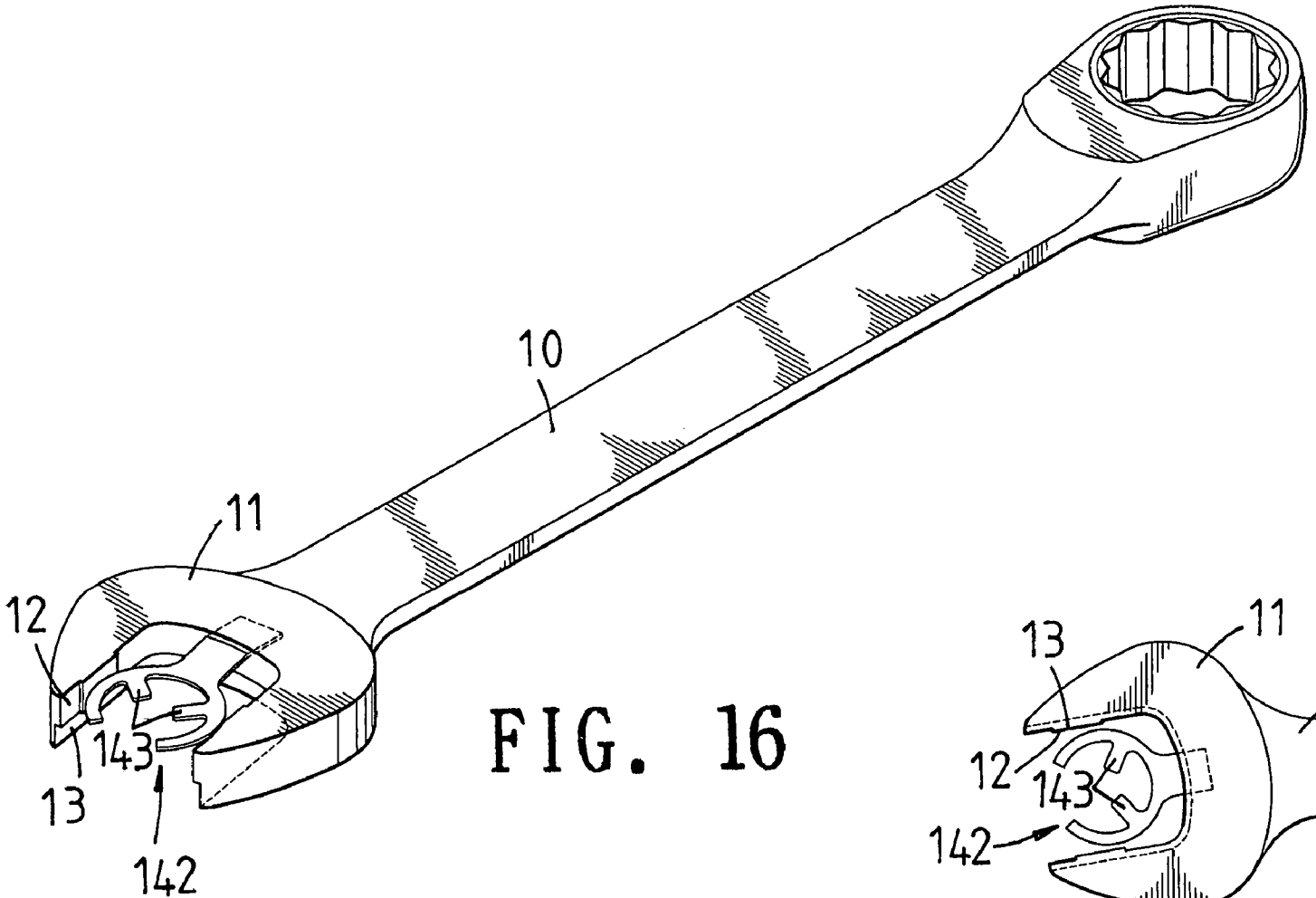
FIG. 16 shows a further embodiment of the pushing tongue.
Figure 17:
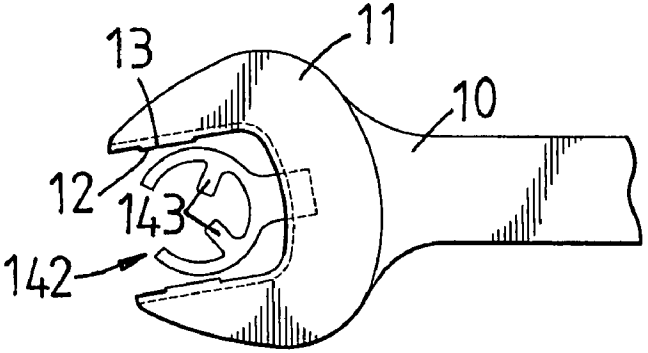
FIG. 17 is a plain view to show the open end with the pushing tongue as disclosed in FIG. 16.

FIGS. 16 and 17 show that the distal end of the pushing tongue is a C-shaped end 142 and flexible plates 143 extend from an inner periphery of the C-shaped end 142.

While we have shown and described the embodiment in accordance with the present invention, it should be clear to those skilled in the art that further embodiments may be made without departing from the scope of the present invention.

What is claimed is:

1. A wrench comprising:

a handle having an open end connected thereto and the open end including two jaws and a connection portion connected between the two jaws, a clamping portion defined in an inside of each jaw and located close to a first side of each jaw, a loose portion defined in the inside of each jaw and located close to a second side of each jaw, a width between the two respective loose portions of the two jaws being wider than a width between the two respective clamping portions of the two jaws, and a pushing tongue located between the two jaws.

2. The wrench as claimed in claim 1, wherein the pushing tongue extends from the connection portion of the open end and a distal end of the pushing tongue extends upward 20 to 30 degrees relative to a body of the pushing tongue.

3. The wrench as claimed in claim 1, wherein the pushing tongue is connected to the connection portion at a position close to the first side of the open end.

4. The wrench as claimed in claim 1, wherein each of the loose portions is a curved recess.

5. The wrench as claimed in claim 1, wherein the clamping portions each have a protrusion extending therefrom.

6. The wrench as claimed in claim 1, wherein the distal end of the pushing tongue is a fork-shaped end.

7. The wrench as claimed in claim 1, wherein the distal end of the pushing tongue is a ring-shaped end.

8. The wrench as claimed in claim 1, wherein the distal end of the pushing tongue is a C-shaped end and flexible plates extend from an inner periphery of the C-shaped end.

* * * * *